United States Patent [19]

Inaba et al.

[11] Patent Number: 4,884,978

[45] Date of Patent: Dec. 5, 1989

[54] CONNECTOR

[75] Inventors: Shigemitsu Inaba; Kazuto Ootaka; Akira Maeda, all of Shizuoka, Japan

[73] Assignee: Yazaki Corporation, Japan

[21] Appl. No.: 275,964

[22] Filed: Nov. 25, 1988

[30] Foreign Application Priority Data

Nov. 25, 1987 [JP] Japan ..... 62-295142

[51] Int. Cl.[4] ..... H01R 13/627

[52] U.S. Cl. ..... 439/352; 439/350; 439/354; 439/357; 439/372

[58] Field of Search ..... 439/350, 352–355, 439/357, 358, 372

[56] References Cited

U.S. PATENT DOCUMENTS 4,674,814 6/1987 Hoshino et al. ..... 439/489 X

FOREIGN PATENT DOCUMENTS 55-49433 3/1980 Japan .

62-10885 1/1987 Japan .

*Primary Examiner*—Steven C. Bishop

*Attorney, Agent, or Firm*—Wigman & Cohen

[57] ABSTRACT

Disclosed herein is a connector which comprises a female housing and a male housing to be inserted and fitted into the female housing for establishing an electrical connection therebetween. The connector further comprises locking member pivotably provided on one of the female and male housings in such a manner that one housing is locked with the other housing by the locking member only when the female and male housings are properly fitted together. The locking member includes engagement projection for temporarily hooking the locking member to one housing until the other housing is inserted into one housing. On the other housing, there is provided a projection for disengaging the lock member from one housing when one housing is inserted into the other housing.

17 Claims, 6 Drawing Sheets

CONNECTOR

BACKGROUND OF THE INVENTION

1. Field of the Invention

This invention relates to a connector, and in particular to a connector comprising a female housing and a male housing to be inserted and fitted into the female housing, and a locking mechanism enabling easy confirmation a proper fitting of the housings.

2. Description of the Prior Art

In connectors including a female housing and a male housing to be inserted and fitted into the female housing, it is very important that the male housing be properly fitted into the female housing in order to establish electrical connection therebetween.

One of such conventional connectors is disclosed in Japanese Laid Open Utility Model Publication No. 55-49433, which comprises a female housing 1 and a male housing 2 to be fitted to the female housing 1. In the female and male housings 1 and 2, there are provided a plurality of female and male terminals, respectively (not shown). The female and male terminals are arranged so as to be connected to each other when the female and male housings 1 and 2 are properly fitted together. On the male housing 2, there is provided a locking arm 3 which is flexibly supported thereon. A locking projection 4 is formed on the locking arm 3. On the female housing 1, there is provided a locking cover 5 with a locking aperture 6. The locking projection 4 and the locking aperture 6 are arranged so as to engage with each other by means of the restoring force of the locking arm 3 only when the housings 1 and 2 are properly fitted together.

In such a conventional connector, however, if the force for inserting the male housing 2 into the female housing 1 is insufficient, there is the unfavorable possibility that an imperfect fitting of the housings may occur, thus leading to a poor electrical connection between the female and male terminals. Namely, there is the possibility that an operator who is connecting the housings may misjudge an imperfect fitting to be a proper fitting.

As a connector that solved such a problem for conventional connectors, there is known an improved connector having a locking mechanism which can easily confirm whether the female and male housings are properly fitted together, and this connector is disclosed in Japanese Laid Open Patent Publication No. 62-10885.

Namely, as shown in FIG. 2, the improved connector 10 comprises a female housing 11 and a male housing 12. The female housing 11 has a fitting space 11*a* therein into which a fitting section 12*a* of the male housing 12 is inserted and fitted.

On the upper surface 11*b* of the female housing 11, there is provided a substantially square locking cover member 13 through a hinge member 14 in such a manner that the cover member 13 is pivotingly rotated between a first position in which the cover member 13 overlaps the upper surface 11*b* of the female housing 11, and a second position in which the cover member 13 is rotated at an angle of about 180° from the first position. On the underside of the cover member 13, there is formed an engagement portion 13*a*. The engagement portion 13*a*, which is formed from a plate-like member, is provided on the cover member 13 so as to protrude into the fitting space 11*a* of the female housing 11 through a slit 11*c* formed on the upper surface 11*a* of the female housing 11 when the cover member 13 is pivoted to the first position.

On the upper surface 12*b* of the fitting section 12*a* of the male housing 12, there are formed two locking projections 15 which lock with a locking portion (not shown) provided in the fitting space 11*a* of the female housing 11 when the male housing 12 is properly fitted to the female housing 11. Further, on the upper surface 12*a* of the male housing 12, there are formed two parallel guide portions 16 which are slidably guided by two guide recesses 11*c* provided in the fitting space 11*a* of the female housing 11. On each of the guide portions 16, there is formed a notch 16*a*. The notches 16*a* are arranged in such a manner that the engagement portion 13*a* of the cover member 13 will be engaged thereto only when the male housing 12 is properly fitted into the female housing 11.

According to this improved connector, before the male housing 12 is inserted into the female housing 11, the cover member 13 is in the second position, as shown in FIG. 3(A). When the male housing 12 is properly fitted into the female housing 11, as shown in FIG. 3(B), the cover member 14 is pivoted to the first position, thereby engaging the engagement portion 13*a* of the cover member 13 with the notches 16*a* of the guide members 16 of the male housing 12. However, as shown in FIG. 3(C), when the male housing 12 is imperfectly fitted into the female housing 11, the cover member 13 can not properly be pivoted to the first position because the engagement portion 13*a* is abutted on the guide members 16. As a result, an operator who is connecting the housing 11 and 12 will be able to perceive when the housings are not properly fitted together, and thus prevent the occurrence of imperfect fittings between the housings 11 and 12.

Although the connector 10 has the above-mentioned advantage, it is required to pivot the cover member 13 from the second position, in which the cover member 13 is opened, to the first position when the female and male housings 11 are to be connected, because the cover member 13 normally resides in the second position as shown in FIG. 3(A). This leads to the disadvantage that the cover member 13 may be damaged by being caught on any parts during the pivoting action of the cover member 13 from the second position to the first position.

SUMMARY OF THE INVENTION

In view of the foregoing disadvantage of the improved connector mentioned above, the present invention has been made. Accordingly, a primary object of the present invention is to provide a connector having a locking mechanism for preventing the occurrence of imperfect fittings between the female and male housings, in which the locking mechanism is constructed so as not to be caught by any parts around the connector when the housings are connected.

In order to accomplish the above object, the connector of the present invention comprises a female housing and a male housing to be inserted and fitted into the female housing for establishing an electrical connection therebetween. The connector further comprises locking means pivotably provided on either the female or male housing in such a manner that one housing is locked with the other housing by the locking means only when the female and male housings are properly fitted together. The locking means includes means for temporarily hooking the locking means to the first housing until the other housing is inserted into the first housing. On the other housing, there is provided means for disengaging the lock means from the first housing while the first housing is inserted into the other housing.

According to the connector having the above structure, since the locking means is temporarily hooked on one housing until the other housing is inserted into the first housing, it is possible to prevent the locking means from being caught on any parts around the connector when the the housing are connected. Further, the locking means is easily disengaged from the first housing only by the insertion of the other housing into the first housing, thus making the connection of the housings relatively easy to accomplish.

BRIEF DESCRIPTION OF THE DRAWINGS

The objects and advantages of the present invention, as well as the details of the preferred embodiments, will be more fully understood when taken in conjunction with the following drawings, in which.

DETAILED DESCRIPTION OF THE PREFERRED EMBODIMENTS

Figure 1:
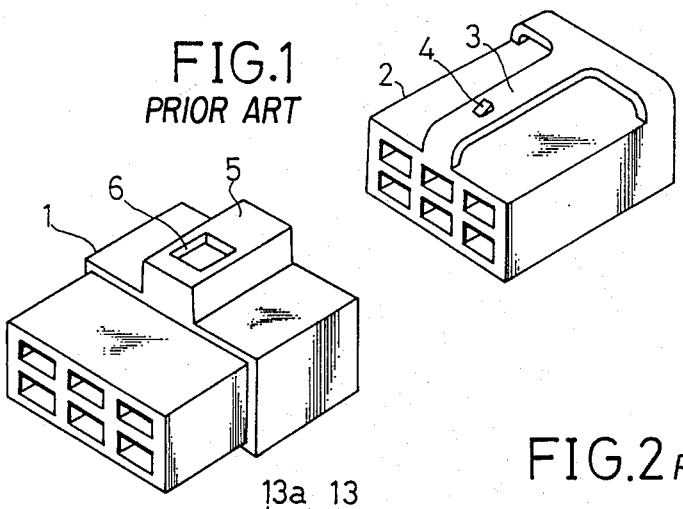
FIG.1 PRIOR ART
FIG. 1 is a perspective view of a conventional connector.
Figure 2:
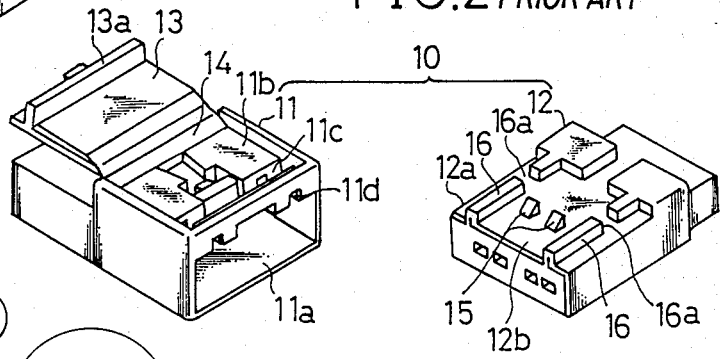
FIG.2 PRIOR ART
FIG. 2 is a perspective view of other conventional connector having a locking mechanism.
Figure 3A:
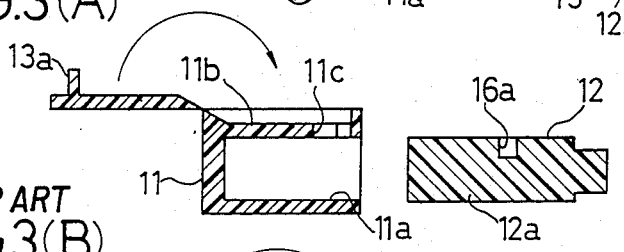
PRIOR ART FIG.3(A)
FIGS. 3(A) to (C) are explanatory drawings showing the fitting processes of the female and male housings of the conventional connector of FIG. 2.
Figure 3B:
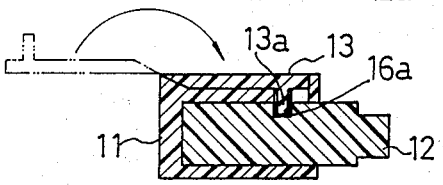
PRIOR ART FIG.3(B)
Figure 3C:
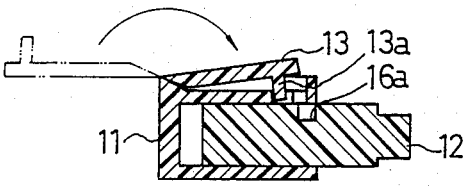
PRIOR ART FIG.3(C)

Referring now to the drawings, the preferred embodiments of the present invention will be described.

Figure 4:
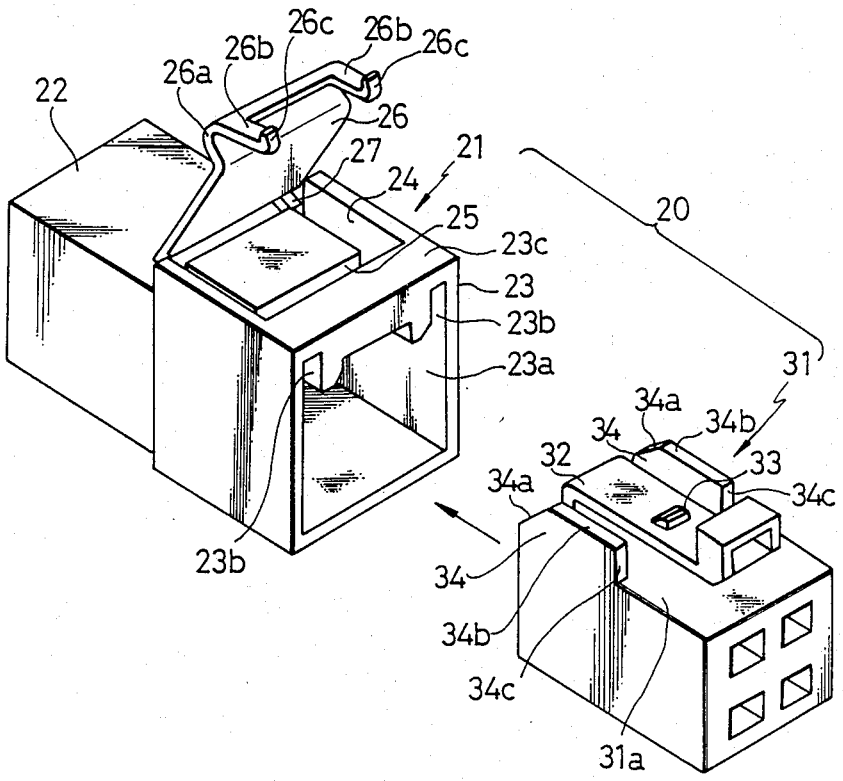
FIG. 4 is a perspective view of the first embodiment of a connector of the present invention.

FIG. 4 shows the first embodiment of the present invention. In the drawing, a connector 20 comprises a female housing 21 and a male housing 31 to be inserted and fitted into the female housing 21. In the female and male housings 21 and 31, a plurality of male and female terminals (not shown) are accommodated, respectively.

The female housing 21 comprises a terminal accommodating section 22 in which the male terminals are accommodated and a fitting section 23 having a fitting space **23*a* into which the male housing 31 is fitted. On the upper side of the fitting space 23*a* of the female housing 21, two guide recesses 23*b* which extend toward the insertion direction of the male housing 31** are provided.

On the upper surface **23*c* of the fitting section 23, there is formed a substantially square concave portion 24. In the concave portion 24, a slit 25 which opens into the fitting space 23*a* is formed at one side thereof that the male housing 31 is inserted. On the opposite side of the concave portion 24, a locking cover member 26 is provided through a hinge member 27 so as to normally open with a small angle with respect to the upper surface 23*c* of the fitting section 23 by elasticity given in the hinge member 27. The locking cover 26 is formed from a substantially square plate having a size to be accommodated in the concave portion 24. Therefore, the locking cover member 26 is pivotable between a first position in which the cover member 26 is accommodated in the concave portion 24 and a second position in which the cover member 26** is opened with one small angle.

On a free edge of the locking cover member 26, there is integrally formed a bent portion **26*a* having a U-shape in cross section so as to generate elasticity therein. On the edge of the bent portion 26*a*, there are formed two locking portions 26*b* at both sides thereof. Each of the two locking portions 26*b* is arranged so as to protrude into the fitting space 23*a* of the female housing 21 through the slit 25 when the locking cover member 26 is in the first position. On the tip portion of each locking portion 26*b*, there is formed an engagement projection 26*c* which is arranged so as to hook with the edge of the slit 25 when the locking cover member 26** is in the first position.

On the upper surface **31*a* of the male housing 31, there is provided a locking arm 32. The locking arm 32 comprises a substantially L-shaped member having a first and a second ends. The first end of the locking arm is attached on the upper surface 31*a* at the front portion of the male housing in such a manner that the second end extends toward the rear portion of the male housing 31, so that the locking arm 32 is flexibly supported on the male housing 31. On the locking arm 32, there is provided a locking projection 33 which engages with a locking portion 23*d* (see FIGS. 5(C) and (D) provided in the female housing 21 when the female and male housings 21 and 31 are properly fitted. On the the upper surface 31*a* of the male housing 31, there are two vertical plate members 34. The vertical plate members are located on both sides of the front portion of the male housing 31 so as to upwardly protrude from the upper surface 31*a* of the male housing 31. Each of the vertical plate members 34 has a substantially trapezoidal shape having an inclined surface 34*a* declining toward the insertion direction of the male housing 31, a flat surface 34*b* and vertical surface 34*c*. Further, the vertical plate members 34 are arranged so as to be guided by the guide recesses 23*b* of the female housing 21 when the male housing 31 is inserted into the female housing 21**.

Hereinafter, the fitting processes of the female and the male housings 21 and 31 will be described.

When the female and male housings 21 and 31 are connected, in advance the locking cover member 26 is to be in the first position by temporarily hooking the engagement projections **26*c* of the cover member 26 with the edge of the slit 25. In this case, the engagement projections 26*c* are hooked with the edge of the slit by the elasticity generated in the bent portion 26*a* of the cover member 26**.

Figure 5A:
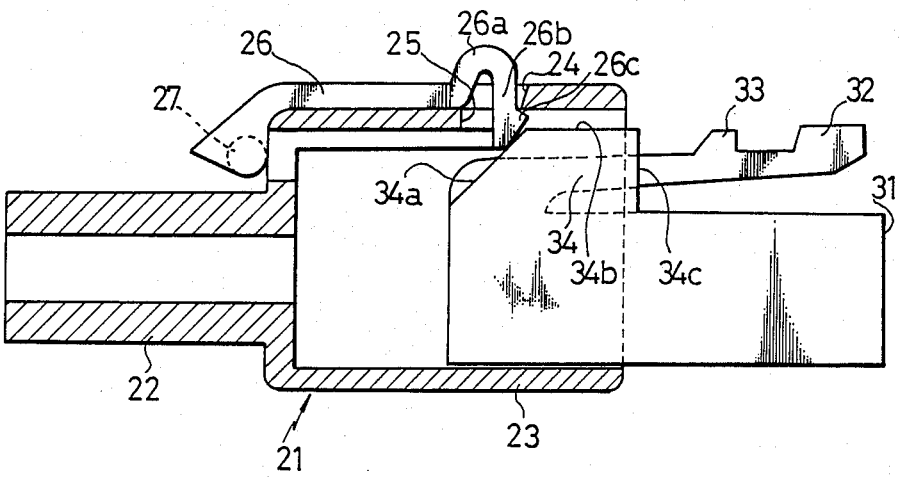
FIGS. 5(A) to (D) are explanatory drawings showing the fitting processes of the female and male housings of the connector of the first embodiment.
Figure 5:
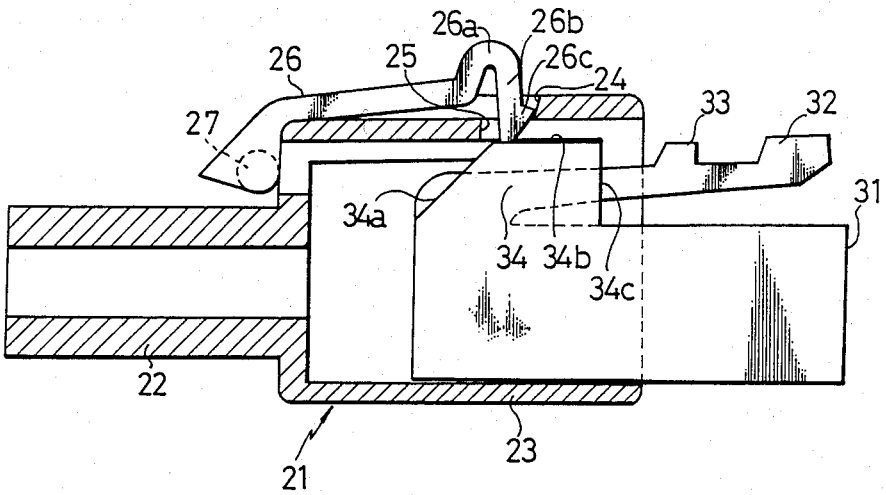

As shown in FIG. 5(A), when the male housing 3 is inserted into the fitting space **23*a* of the female housing 21, the locking cover member 26 keeps in its first position until the inclined surfaces 34*a* of the vertical plate members 34 contact with the engagement projections 26*c* of the cover member 26**.

Figure 5C:
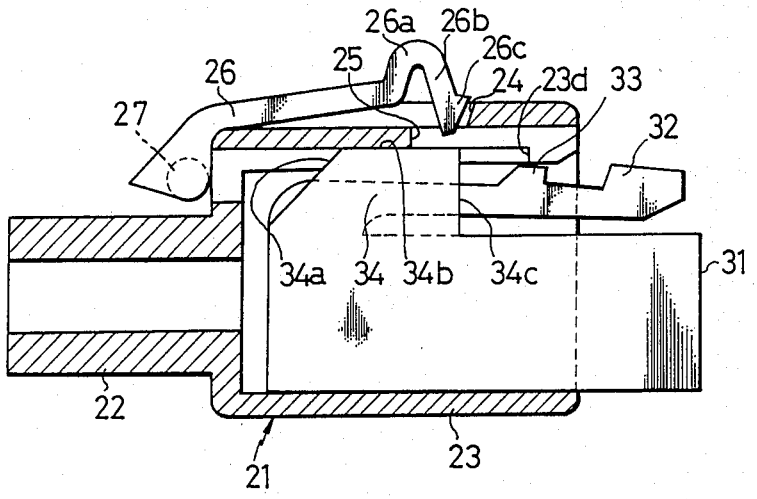

When the male housing 31 is further inserted into the fitting space **23*a* of the female housing 21 from the position of FIG. 5(A), the inclined surface 34*a* of the vertical plate member 34 abuts on the engagement projection 26*c* so as to deform the U-shaped bent portion 26*a*, thereby the engagement projections 26*c* are disengaged from the edge of the slit 25, as shown in FIG. 5(B). Then, the locking cover member 26 is automatically pivoted to the second position by the elasticity in the hinge member 27, as shown in FIG. 5(C). Namely, the engagement projections 26***c* of the locking cover member 26 are easily disengaged from the edge of the slit 25 only by the insertion of the male housing 31, thus making the connection of the housings relatively easy to accomplish. Further, under the condition, even if an operator attempts to return the locking cover member 26 to the first portion in order to lock the housings, it is not possible to do so since the locking portions 26*b* of the locking cover member 26 are abutted on the flat surfaces 34*b* of the vertical plate members 34 of the male housing 31. As a result, the operator perceives that the male housing 31 is not yet fitted to the female housing 21 perfectly.

Figure 5D:
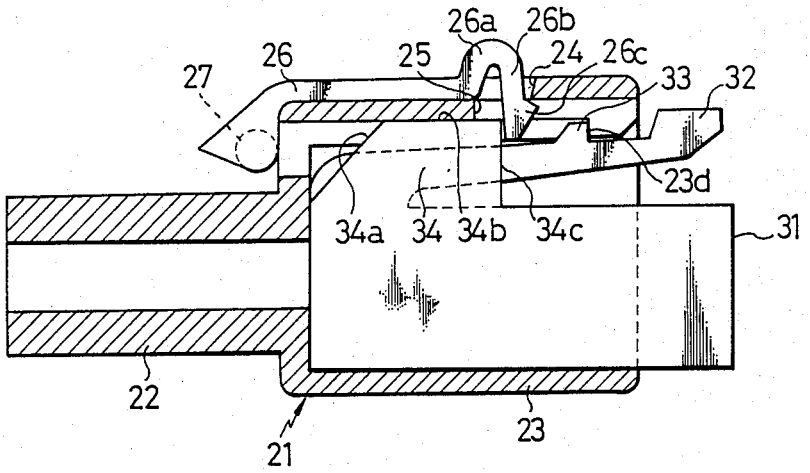

As shown in FIG. 5(D), when the male housing 31 is completely fitted to the female housing 31, the cover member can be pivoted to the first position and then the locking portions 26*b* of the locking cover member 26 are locked with the vertical surfaces 34*c* of the vertical plate members 34 of the male housing 31, thereby it is possible to confirm the perfect fitting of the female and male housings 21 and 31. In this condition, the locking projection 33 of the locking arm 32 of the male housing 31 is also locked with locking portion 23*d* of the female housing 21, thereby the female and male housings 21 and 31 are doubly locked together.

Figure 6:
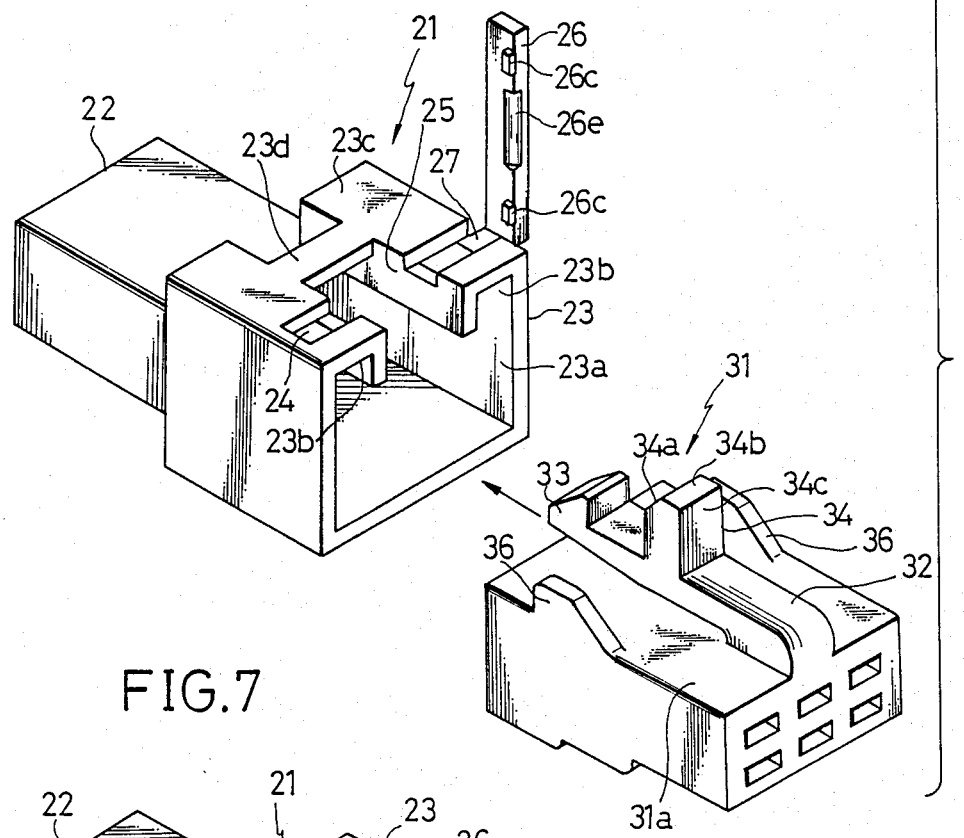
FIG. 6 is a perspective view of the second embodiment of a connector of the present invention.

FIG. 6 shows the second embodiment of a connector of the present invention. The connector of the second embodiment has substantially the same structures and functions as those of the connector of the first embodiment. Therefore, the same number will be used in the drawings to designate the same part in each embodiment.

In FIG. 6, a female housing 21 comprises a terminal accommodating section 22 in which a plurality of male terminals are accommodated and a fitting section 23 having a fitting space 23*a* into which a male housing 31 is fitted. On the upper side of the fitting space 23*a*, there are provided two guide recesses 23*b* which extend toward the insertion direction of the male housing 31.

On the upper surface 23*c* of the fitting section 23, there is formed a longitudinal slit 24 which also extends toward the insertion direction of the male housing 31. Further, on the upper surface 23*c* of the fitting section 23, there is formed a concave portion 24 so as to traverse the slit 25. At one end of the concave portion 24, there is provided a locking lever 26 through a hinge member 27 in such a manner that the locking lever 26 is normally opened with a small angel with respect to the upper surface 23*c* of the fitting section 23 by means of elasticity given in the hinge member 27. The locking lever 26 has a size to be accommodated in the concave portion 24. Therefore, the locking lever 26 is pivotable between a first position in which the locking lever 26 is accommodated in the concave portion 24 and a second position in which the locking lever 26 is opened with the small angle. On the under side of the locking lever 26, there are provided two engagement projections 26*c* which are arranged so as to temporarily hook with edges of openings in the concave portion 24, respectively, when the locking lever 26 is pivoted to the first position. Between the engagement projections 26*c*, there is formed an inclined surface portion 26*e*. Furthermore, on the upper surface 23*c* at the side of the terminal accommodating section 22, there is provided a locking portion 23*d* so as to span the slit 25.

On the upper surface 31*a* of the male housing 31, there is provided a locking arm 32. The locking arm 32 comprises a substantially L-shaped member having first and second ends. The first end of the locking arm 32 is attached on the upper surface 31*a* of the rear portion of the male housing 31 in such a manner that the second end extends toward the front portion of the male housing 31, so that the locking arm 32 is flexibly supported on the male housing 31. On the tip portion of the locking arm 32, there is provided a first locking projection 33 which engages with a locking portion 23*d* of the female housing 21 when the female and male housings 21 and 31 are properly fitted together. Further, on the locking arm 32 between the first and second ends thereof, there is provided a second projection 34. The tip portion of the second projection 34 has a substantially trapezoidal shape in cross section, which has an inclined surface 34*a* declining toward the insertion direction of the male housing 31, a flat surface 34*b* and vertical surface 34*c*. Further, on the upper surface 31*a* of the male housing 31, there are provided two guide plates 36 which are arranged so as to be guided by the guide recesses 23*b* of the female housing 21 when the male housing 31 is inserted into the female housing 21.

Hereinafter, the fitting processes of the female and the male housings 21 and 31 of the second embodiment will be described.

Figure 7:
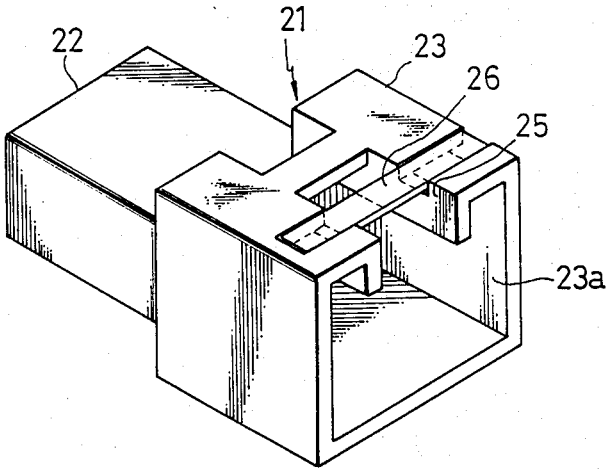
FIG. 7 is a perspective view of the female housing of the connector of the second embodiment.

When the female and male housings 21 and 31 are connected, in advance the locking lever 26 is to be in the first position by temporarily hooking the engagement projections 26*c* with the edges of the openings of the concave portion 24. This condition is shown in FIG. 7.

Figure 8A:
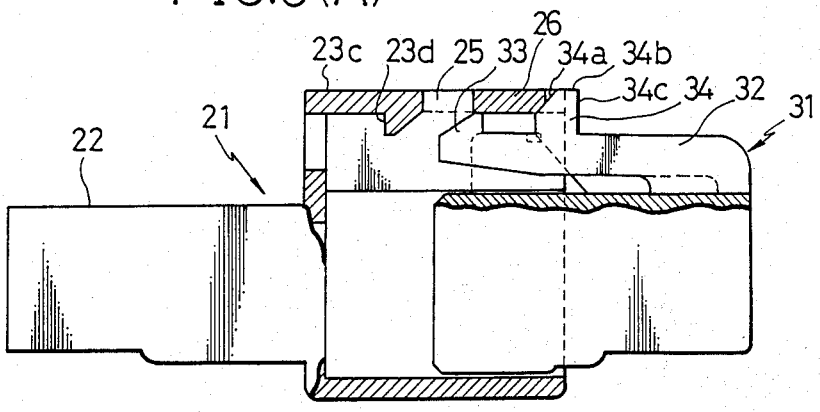
FIGS. 8(A) to (C) are explanatory drawings showing the fitting processes of the female and male housings of the connector of the second embodiment.

As shown in FIG. 8(A), when the male housing 31 is inserted into the fitting space 23*a* of the female housing 21 and then the inclined surface 34*a* of the second projection 34 abuts on the inclined surface portion 26*e* of the locking lever 26, the engagement projections 26*c* of the locking lever 26 are disengaged from the edges of the openings of the concave portion 24, as shown in FIG. 5(B). Then, the locking lever 26 is automatically pivoted to the second position by the elasticity given in the hinge member 27. Namely, the engagement projections 26*c* of the locking lever 26 are easily disengaged from the edges only by the insertion of the male housing 31 to the female housing 21, thus making the connection of the housings relatively easy to accomplish.

Figure 8B:
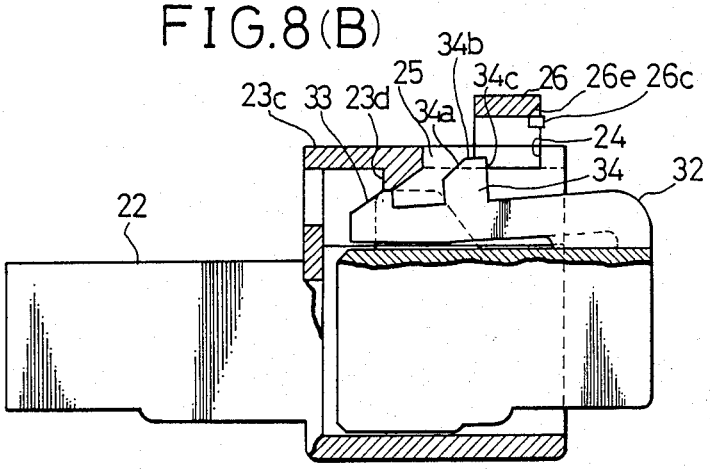

FIG. 8(B) shows the imperfect fitting condition of the female and male housings 21 and 31. Under the condition, even if an operator attempts to pivot the locking lever 26 to the first portion in order to lock the housings, it is not possible to do so since the under surface of the locking lever 26*b* are abutted on the flat surfaces 34*b* of the second projection 34. As a result, the operator perceives that the male housing 31 is not yet fitted to the female housing 21 perfectly.

Figure 8C:
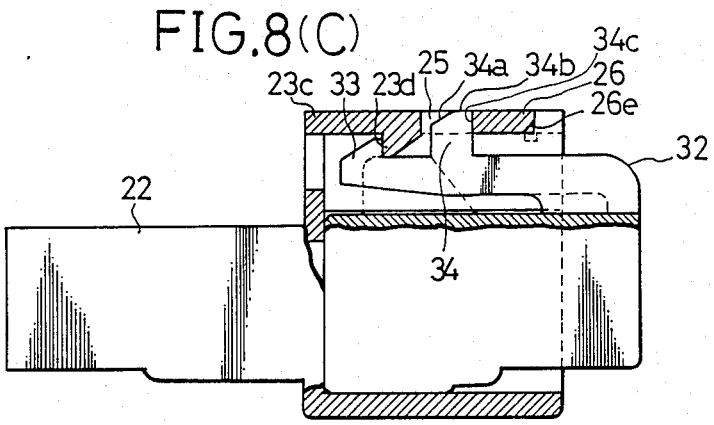

As shown in FIG. 8(C), when the male housing 31 is completely fitted to the female housing 31, the locking lever 26 are locked with the vertical surfaces 34*c* of the second projection 34 of the male housing 31, thereby it becomes possible to confirm the perfect fitting of the female and male housings 21 and 31. In this condition, the locking projection 33 of the locking arm 32 of the male housing 31 is also locked with locking portion 23*d* of the female housing 21, thereby the female and male housings 21 and 31 are doubly locked together.

In these embodiments, the locking cover member or the locking lever is integrally formed on the fitting section of the female housing 21 through the hinge member. However, it is of course possible to form the locking cover member or the locking lever as a separate part.

Further, in these embodiments, it is also possible to remove the locking mechanism constituted by the locking arm of the male housing and the locking portion of the female housing.

It must be understood that the invention is no way limited to the above embodiments and that many changes may be brought therein without departing from the true scope of the invention as defined by the appended claims.

What is claimed is:

1. A connector, comprising:

a female housing;

a male housing inserted and fitted into said female housing for establishing an electrical connection therebetween;

lock means pivotably provided on one of said female and male housings in such a manner that said one housing is locked with the other housing by said lock means only when said female and male housings are properly fitted together;

means for temporarily hooking said locking means to the one housing until the other housing is inserted into said one housing, said hooking means provided on said lock means; and means for disengaging said lock means from said one housing while the other housing is inserted into said one housing, said disengaging means provided on the other housing.

2. A connector as claimed in claim 1, wherein said one housing is said female housing and the other housing is said male housing.

3. A connector as claimed in claim 2, wherein said female housing has a fitting space into which said male housing is inserted and an upper surface with a slit opening to the fitting space, and said locking means includes a locking member pivotably provided on said female housing by hinge means, and said locking member has at least one locking portion which protrudes into said fitting space through the slit so as to lock with said male housing when said male housing is perfectly fitted to said female housing.

4. A connector as claimed in claim 2 wherein said female housing has a concave portion formed on the upper surface thereof, and said locking member is constructed in such a manner that said locking member is pivotable between a first position in which said locking member is accommodated in said concave portion and a second position in which said locking member is rotated with a small angle with respect to the upper surface of said female housing.

5. A connector as claimed in claim 4, wherein said hooking means comprises an engagement projection formed on said locking member in such a manner that said projection is temporarily hooked with said female housing when said locking member is in the first position.

6. A connector as claimed in claim 5, wherein said disengaging means comprises an inclined surface means for disengaging said engagement projection from said female housing when said male housing is inserted into said female housing.

7. A connector as claimed in claim 6, wherein said male housing has means for preventing said locking member from pivoting to the first position when said male housing is imperfectly fitted to said female housing, whereby enabling a confirmation of imperfect fitting of said housings.

8. A connector as claimed in claim 7, wherein said male housing has an upper surface and at least one substantially trapezodial plate member provided on the upper surface thereof, ans said plate member has an inclined surface declining toward the insertion direction of the male housing, a flat surface and a vertical surface, wherein said inclined surface means comprises said inclined surface of the plate member and said preventing means comprises said flat surface, and said locking portion of said locking member is locked with the vertical surface.

9. A connector as claimed in claim 8, wherein said locking member comprises a substantially square plate having two locking portions, and said male housing has two trapezodial plate members.

10. A connector as claimed in claim 9, wherein said connector further comprises another locking mechanism which comprise a flexible locking arm, which is provided on said male housing, having a locking projection to be locked with a partner member of said female housing when said female and male housings are properly fitted together.

11. A connector as claimed in claim 7, wherein said male housing further comprises a flexible locking arm having a projection, and said projection has a tip portion which has a substantially trapezodial shape having an inclined surface declining toward the insertion direction of the male housing, a flat surface and a vertical surface, wherein said inclined surface means comprises the inclined surface of the projection and said preventing means comprises the flat surface, and said locking portion of said locking member is locked with the vertical surface.

12. A connector as claimed in claim 11, wherein said locking member comprises a substantially lever-shaped member having an inclined surface to which the inclined surface of the projection of the male housing is abutted for facilitating the disengagement of said locking member.

13. A connector as claimed in claim 12, wherein said connector further has another locking mechanism which comprises another locking projection formed on the flexible locking arm and a partner member provided on said female housing.

14. A connector having a female housing and a male housing inserted and fitted into said female housing for establishing an electrical connection therebetween, which comprises a first locking meachanism, comprising:

lock means pivotably provided on one of said female and male housings in such a manner that said one housing is locked with the other housing by said lock means only when said female and male housings are properly fitted together;

means for temporarily hooking said locking means to said one housing until the other housing is inserted into said one housing, said hooking means provided on said lock means; and means for disengaging said lock means from said one housing while the other housing is inserted into said one housing, said disengaging means provided on the other housing; and a second locking mechanism for locking said female and male housings when said male housing are properly fitted together.

15. A connector as claimed in claim 14, wherein said one housing is said female housing and the other housing is said male housing.

16. A connector as claimed in claim 15, wherein said second locking mechanism comprises a flexible locking arm, which is provided on said male housing, having a locking projection and a partner member provided on said female housing so as to lock with said locking projection when said female and male housings are properly fitted together.

17. A connector as claimed in claim 16, wherein said disengaging means is provided on said flexible locking arm.

* * * * *

UNITED STATES PATENT AND TRADEMARK OFFICE

CERTIFICATE OF CORRECTION

PATENT NO. : 4,884,978

DATED : December 5, 1989

INVENTOR(S) : INABA ET AL

It is certified that error appears in the above-identified patent and that said Letters Patent is hereby corrected as shown below:

IN THE ABSTRACT

Line 6, after "comprises" insert --a--;

Line 15, change "lock" to --locking--.

Column 1, line 10, change "a" to --and--.

Column 3, line 24, change "other" to --another--.

Column 4, line 32, after "(D)" insert --)--;

line 57, please change "3" to --31--.

Column 5, line 9, change "the" to --this--;

line 19, please change "31" to --21--;

line 45, please change "24" to --25--;

line 52, please change "angel" to --angle--.

Column 6, line 60, please change "31" to --21--;

line 61, please change "are" to --is--.

IN THE CLAIMS:

Claim 8, column 8, line 10, change "ans" to --and--;

Claim 14, column 8, line 54, please change "meachanism" to read --mechanism--.

UNITED STATES PATENT AND TRADEMARK OFFICE

CERTIFICATE OF CORRECTION

PATENT NO. : 4,884,978

DATED : December 5, 1989

INVENTOR(S) : INABA ET AL

It is certified that error appears in the above-identified patent and that said Letters Patent is hereby corrected as shown below:

Claim 14, column 9, line 2, after "said" please insert --female and said--; after "male" (second occurrence) please change "housing" to --housings--.

Signed and Sealed this

Twenty-third Day of April, 1991

*Attest:*

*Attesting Officer*

HARRY F. MANBECK, JR.

*Commissioner of Patents and Trademarks*